US005414208A

United States Patent [19]

Ramm

[11] Patent Number: 5,414,208

[45] Date of Patent: May 9, 1995

[54] FORMATION OF DENSIFIED MATERIAL

[75] Inventor: John E. Ramm, New South Wales, Australia

[73] Assignee: Australian Nuclear Science & Technology Organisation, Australia

[21] Appl. No.: 50,173

[22] PCT Filed: Oct. 18, 1991

[86] PCT No.: PCT/AU91/00485

§ 371 Date: Jun. 10, 1993

§ 102(e) Date: Jun. 10, 1993

[87] PCT Pub. No.: WO92/07364

PCT Pub. Date: Apr. 30, 1992

[30] Foreign Application Priority Data

Oct. 18, 1990 [AU] Australia ..... PK2858

[51] Int. Cl.[6] ..... A62D 3/00

[52] U.S. Cl. ..... 588/249; 100/37; 100/249; 110/346

[58] Field of Search ..... 588/249; 405/128, 129; 252/633, 628; 100/229 A, 214, 249, 37; 110/236, 346

[56] References Cited

U.S. PATENT DOCUMENTS

| | | | |
|---|---|---|---|
| 4,008,658 | 2/1977 | Stock et al. | 100/229 R |
| 4,036,359 | 7/1977 | Strickland | 100/37 X |
| 4,040,230 | 8/1977 | Pessel et al. | 100/249 X |
| 4,102,262 | 7/1978 | Liberman et al. | 100/229 A |
| 4,389,928 | 6/1983 | Burgin | 100/37 |
| 4,590,000 | 5/1986 | Baatz et al. | 100/249 X |
| 4,642,204 | 2/1987 | Burstrom et al. . | |
| 4,645,624 | 2/1987 | Ramm et al. . | |
| 4,646,633 | 3/1987 | Falguieres | 100/37 |
| 4,834,917 | 5/1989 | Ramm et al. . | |
| 4,877,353 | 10/1989 | Wistosky | 588/249 |
| 4,929,394 | 5/1990 | Kitagawa et al. . | |
| 5,323,719 | 6/1994 | Withers et al. | 110/346 |

FOREIGN PATENT DOCUMENTS

| | | |
|---|---|---|
| 0044692 | 1/1982 | European Pat. Off. . |
| 0209339 | 1/1987 | European Pat. Off. . |
| 0230732 | 8/1987 | European Pat. Off. . |

*Primary Examiner*—Dennis L. Taylor
*Attorney, Agent, or Firm*—Kelly, Bauersfeld & Lowry

[57] ABSTRACT

Dense ceramic material in the form of a block is made in a hot uniaxial press, particulate precursor material for the ceramic being supplied in cylindrical metal capsules having a convoluted or bellows-like side wall which are supplied in a stream with an elongated cylindrical spacer of greater diameter between adjacent metal capsules. Each spacer has a recessed end face for accommodating a corresponding end portion of a metal capsule so that the metal capsule is centered and there is restraint against radially outward expansion of the capsule under the heat and pressure which is applied. The apparatus is operated essentially continuously and the stream moves progressively upwardly so that the discharge of processed containers and spacers occurs at the upper end and capsules to be processed and spacers are inserted intermittently at the lower end.

21 Claims, 3 Drawing Sheets

FORMATION OF DENSIFIED MATERIAL

The present invention relates to the formation of densified material and more particularly is concerned with producing blocks of densified material formed from particulate solid material. The invention will be exemplified with particular reference to the problem of a system for providing a synthetic rock structure in which high level radioactive waste is to be immobilised in a manner suitable for safe long term storage.

The present applicants through their prior published patent specifications have disclosed systems for immobilising high level radioactive waste. Synthetic rock precursor material is impregnated with liquid high level radioactive waste, and a pourable granulated solid is formed. This solid is then poured into a suitable container which, after closure, can undergo a pressure process at elevated temperature in order to produce a uniform densified block of synthetic rock which has extraordinarily high leach resistance.

Such processes must be conducted in active cells which are very expensive to build and the process must be operated with remote manipulators. Commercial factors dictate that the process must be capable of being operated for a large number of years with just simple maintenance by remote manipulators. Exceedingly high reliability is required. Thus there has been a longstanding need to conceive of and develop elegant engineering solutions aimed at providing the highest possible through-put of processed material in the smallest volume of active cell space.

The present invention is directed to providing new and useful alternatives to previous proposals. It will be appreciated that although the invention has particular application to processing nuclear waste into synthetic rock form, the process arrangements may be equally valuable for other purposes such as the formation of sophisticated ceramic materials of non-radioactive character. For machining into components of different types, there is a need to be able to produce efficiently cylindrical blocks of ceramic and embodiments of the invention can be useful in this field.

According to a first aspect of the present invention, there is provided a method of forming a densified block of material from a particulate solid, the method comprising (a) arranging a vertically extending tubular furnace with open ends for providing an entry and a discharge for processing elements to be passed in a stream through the furnace, the processing elements comprising canisters and spacer elements, pressure means being provided to be selectively operable to exert a compressive force only along the axis of the furnace and onto the stream of processing elements, (b) supplying the particulate solid in the canisters, each canister being of generally cylindrical form and a clearance fit in the furnace, each canister having axial end walls and a bellows-like convoluted side wall extending between the end walls, each canister being formed to retain the solid and to compress axially with no substantial radial expansion in the process, (c) supplying spacer elements to co-operate with the supplying of canisters whereby the stream is formed as a vertical column extending through the furnace, each spacer element being a rigid, refractory, cylindrical element dimensioned to move along the tubular furnace during the process and having end walls each shaped to engage with an axial end wall of a canister for controlling the location of the canister so as to be spaced from the wall of the furnace and for controlling uniaxial compression of the canisters, (d) operating the pressure means to compress the column and after sufficient residual time to displace a processing element through the discharge end of the furnace, (e) removing the applied pressure from time to time and either or both (i) removing a processing element from the discharge end and (ii) inserting a new processing element at the entry end of the furnace, and (f) activating holding means to support the column of processing elements to enable substitution of the lowermost processing element in the column.

The invention in another aspect extends to an apparatus for practising the above described method and also to product resulting from use of the method or apparatus.

In one apparatus aspect of the invention, there is provided a tubular furnace for semi-continuous operation and arranged to be mounted vertically when in use and having ends providing an inlet and a discharge for cylindrical processing elements which are to be subject to uniaxial pressure along the axis of the furnace while being maintained at elevated temperature, the apparatus comprising selectively operable pressure means for exerting uniaxial pressure on a column of processing elements located in and extending through the furnace and holding means for holding the column of processing elements in the furnace while the pressure means is deactivated and a further processing element below the column may be manipulated with respect to the column. Where the apparatus is adapted for upward advance of processing elements, a new element is inserted when the holding means is activated.

Embodiments of the invention can operate with the processing elements being moved downwardly from an upper inward end to a lower discharge end or, more preferably, in the opposite upward direction.

In one embodiment, the processing elements in the column comprise an alternating stream of spacer elements and canisters. However, depending upon the particular shape and dimensions of the apparatus and the canisters, it may be possible for the spacers to be inserted only periodically in the column and two or more adjacent canisters might be useable.

A preferred embodiment is one which the spacer elements have ends which have a flat central region surrounded by an annular collar whereby each canister is centralised. Preferably the canister has a curved junction between each flat end wall and the convolutions in the side wall and the spacer has a corresponding curve in the junction between the annular collar and the flat central region.

The spacer elements preferably are cylindrical and have an axial length in a preferred embodiment of the same order of magnitude as the diameter. The spacer elements can be a sliding fit or a close clearance fit within the tabular furnace.

In a typical embodiment, the tubular furnace will have a diameter in the range of 100 to 200 mm.

Preferably, the pressure means comprises hydraulic rams arranged above and below the furnace and adapted to co-operate to maintain equal forces on the column. Advantageously, the apparatus includes sensing means such that any difference in the forces applied is indicative of one or more of the processing elements jamming in the furnace tube and rectification action is then required.

The holding means is preferably a simple mechanical clamp and the apparatus preferably has an automatic control system to co-ordinate all operations and to provide controlled progressive displacement of the processing elements through the tubular furnace.

An embodiment of the invention will now be described with reference to the accompanying drawings, of which:

Figure 1:
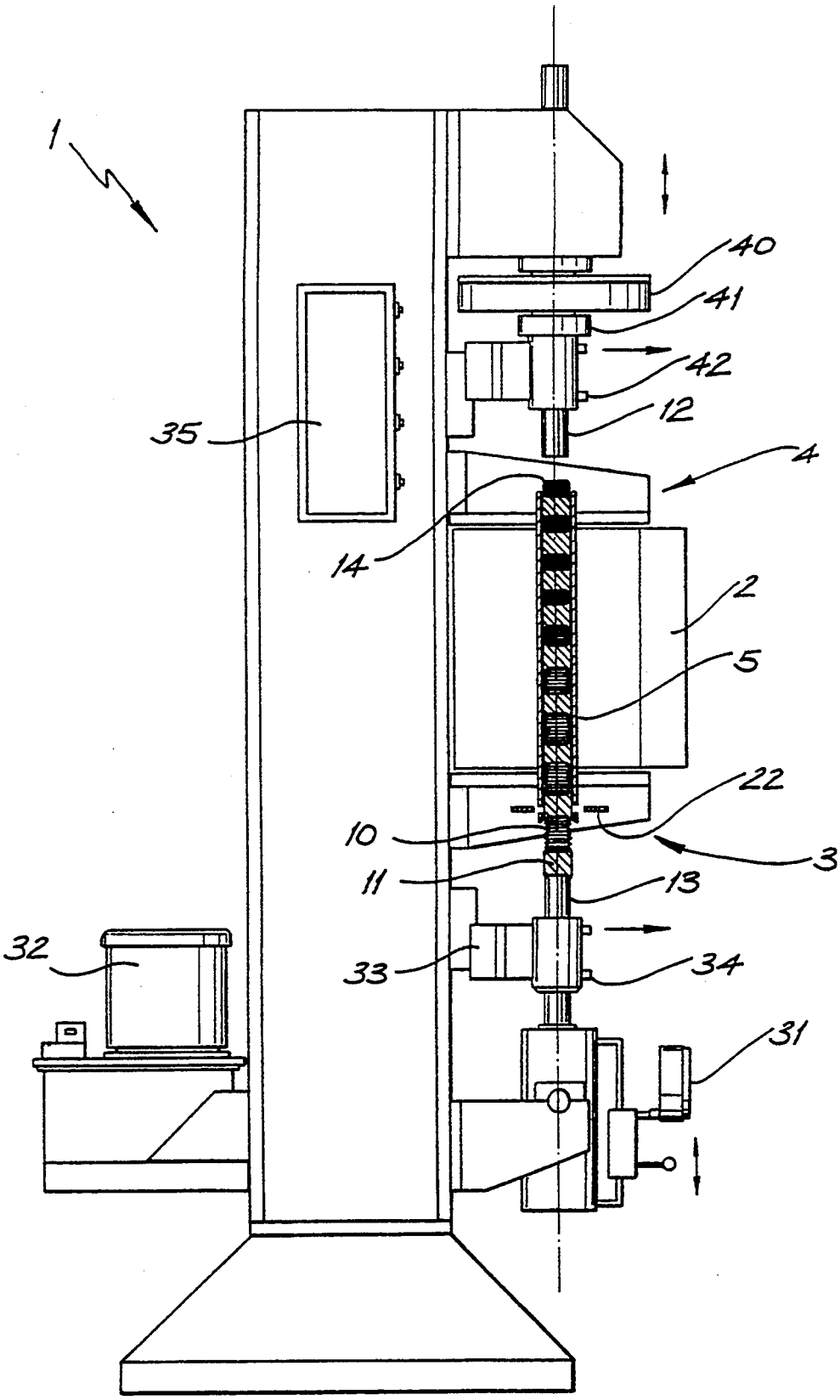
FIG. 1 is a schematic part-sectional vertical elevation of an embodiment of the invention when operating.

Referring to the drawings, FIG. 1 depicts a continuous hot pressing apparatus 1 comprising a furnace 2 with a lower feed end 3 and an upper discharge end 4. Capsules 10 and spacers 11 enter the furnace at the feed end 3 and exit the furnace at discharge end 4. The furnace comprises a densification tube 5 aligned with an upper hydraulic ram 12 and a lower hydraulic ram 13.

Figure 2:
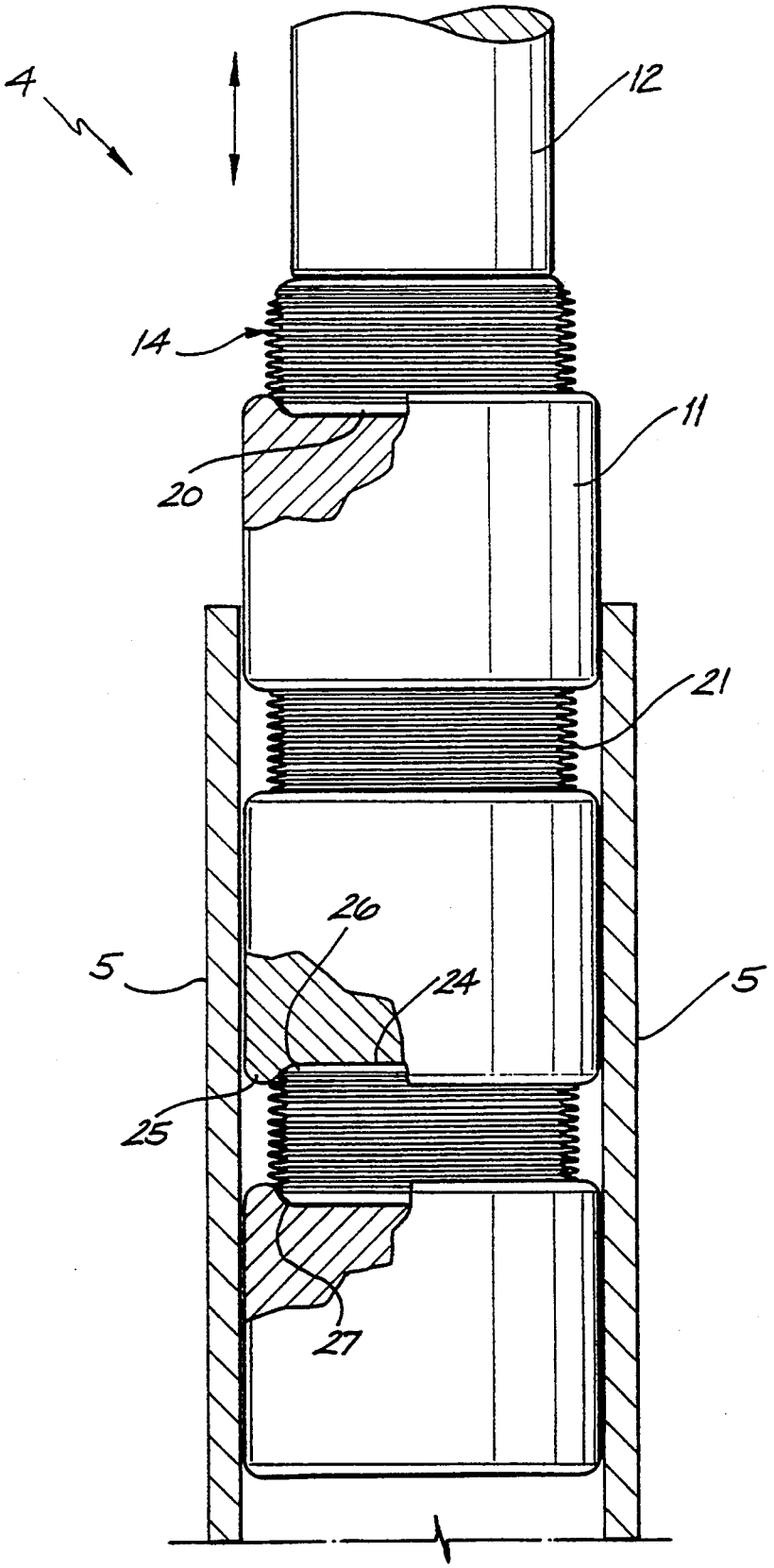
FIG. 2 is a sectional view on an enlarged scale of the discharge upper end of the apparatus.
Figure 3:
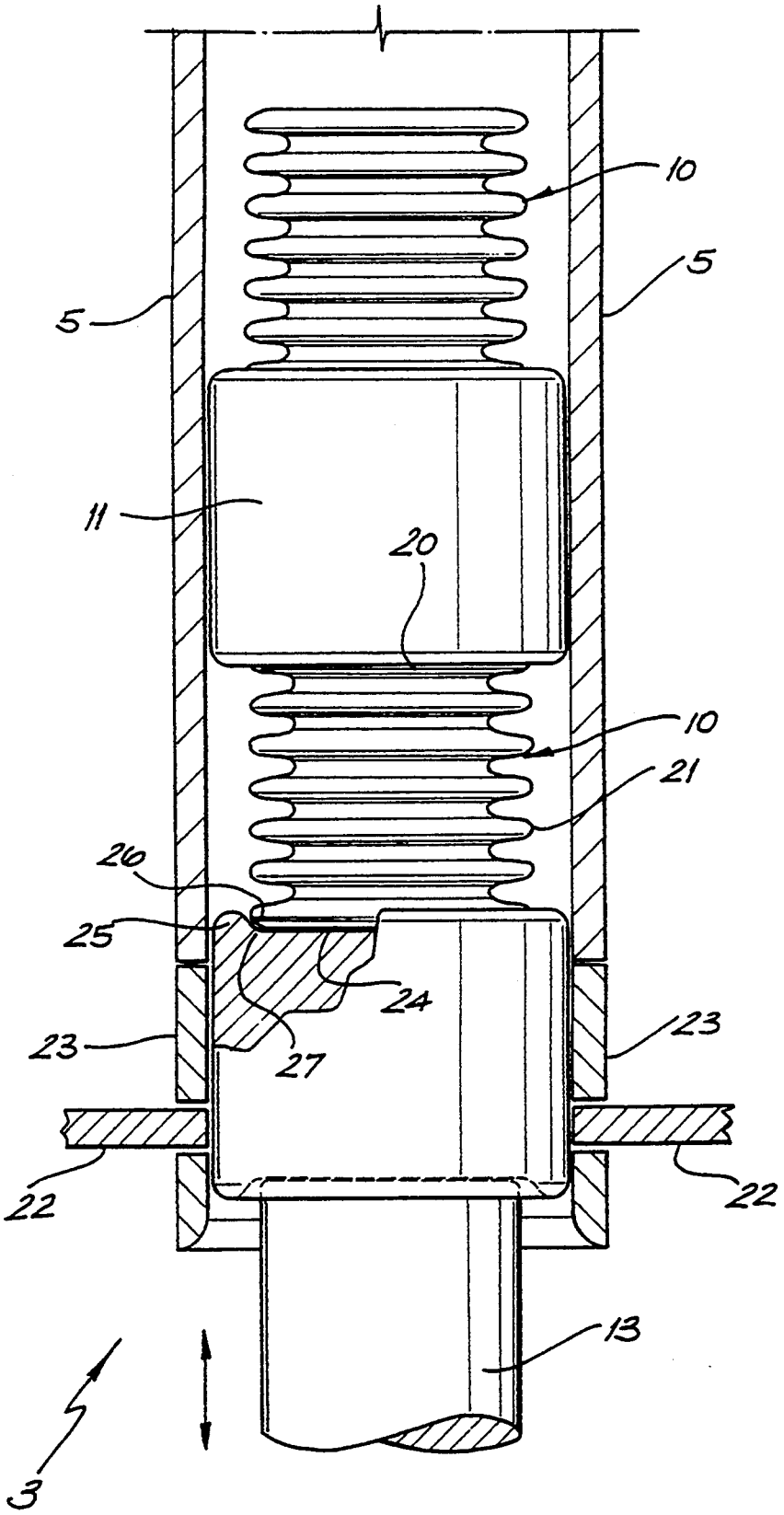
FIG. 3 is a similar sectional view on an enlarged scale of the lower feed end of the apparatus.

FIGS. 2 and 3 show the capsules 10 and spacers 11 in more detail. Each capsule comprises axial end walls 20 and a bellows-like convoluted side wall 21. The spacers have ends which have a flat central region 24 surrounded by an annular collar 25. Each capsule has a curved junction 26 between each axial end wall 20 and convoluted side wall 21, each spacer has a corresponding curve 27 in the junction between the flat central region 24 and the annular collar 25.

FIG. 3 also shows the densification tube 5 in greater detail. A guide tube 23 is attached to the lower end of the densification tube 5, and a column clamp 22 extends through the wall of guide tube 23.

The continuous hot pressing apparatus 1 of FIG. 1 further comprises a control panel 35 for remote operation of the system.

The upper ram 12 is connected through a load cell 41 to a variable speed drive 40. Temperature in the upper ram is regulated by the flow of cooling water 42. Similarly, temperature in the lower ram 13 is regulated by the flow of cooling water 34. The lower ram is driven by hydraulic power unit 32, pressure generated by the hydraulic unit being monitored by pressure gauge 31. A slide 33 braces the lower ram 13 preventing any lateral movement in the lower ram.

In operation, densification tube 5 is filled with an alternate arrangement of capsules and spacers. An uncompressed capsule 10 is fed in at the feed end 3 and a densified capsule 14 is removed after compression from the discharge end 4.

At the end of a compression cycle, the lowermost spacer in the densification tube is clamped. The upper ram is then retracted and a spacer and densified capsule are removed from the discharge end. The upper ram is then lowered to contact the next uppermost capsule. The lower ram is retracted and a further spacer and capsule are loaded thereon. It is necessary that a spacer is loaded between the capsule and upper surface of the lower ram because the lowermost element to be subsequently clamped in the densification tube should be a spacer in this preferred embodiment.

The hydraulic power unit 32 is then activated, and the lower ram is driven upwardly until the capsule thereon contacts the lowermost clamped spacer. The column clamp 22 is then released and the lower ram is driven upwardly and, as the compression process proceeds, the lower ram gradually moves partially into the guide tube (as depicted in FIG. 3) while the upper ram is retracting. The pressure between the upper and lower ram is equalized and maintained at a pre-specified pressure. The control system operates gradually to raise the upper ram so that the stream of capsules and spacers moves gradually to an end portion at the end of the cycle in which the uppermost capsule and spacer are above the tube 5.

The lowermost spacer is then clamped, and the upper ram is retracted, sufficiently such that the uppermost densified capsule and spacer element can be removed from the discharge end. The upper ram is then extended downwardly by the variable speed drive 40 until it contacts the uppermost capsule. The lower ram is retracted and re-loaded with a spacer and capsule. The process cycle is then repeated.

The construction of each spacer and capsule is such that during compression any radial expansion of the capsule is minimised by virtue of the annular collar 25 in the spacer which centres the capsule by interacting with curved junction 26 in the capsule. This construction prevents the capsule from bellowing outwards during compression thereby blocking the densification tube.

The speed and throughout of compression is controlled by the hydraulic pressure employed and the speed of retraction of the upper ram. The speed of retraction of the upper ram is in turn controlled by the variable speed drive. The load cell monitors the pressure in the upper ram and the process is operated such that the pressure in the upper ram and lower ram are substantially equal. Any large differential in pressure between the upper and lower rams (for example where there is significantly larger pressure in the lower ram) indicates that there has been a blockage or jamming in the compression column.

The furnace is operated at elevated temperatures, the temperature being pre-determined by the degree of densification required (eg for the compression of synthetic rock). The furnace temperature is controlled to be hottest towards the centre of the column, so that less costly heat resistant steels can be used in the upper and lower rams. Accordingly the upper and lower rams are cooled by a suitable cooling medium, a water circuit in this case.

The process can be completely automated and operated continuously.

I claim:

1. A method of forming a densified block of material from a particulate solid, the steps comprising:

operating a vertically extending tubular furnace with open ends for providing an entry and a discharge for processing elements to be passed in a stream through the furnace;

supplying the particulate solid in a plurality of canisters, each canister being formed to retain the solid and to compress axially with no substantial radial expansion in the process;

supplying spacer elements to co-operate with the supplying of canisters whereby a stream of processing elements comprising canisters and spacer elements is formed as a vertical column extending through the furnace, each spacer element being dimensioned to move along the tubular furnace during the process and having end walls each shaped to engage with an axial end wall of a canister for controlling the location of the canister so as to be spaced from the wall of the furnace and for controlling uniaxial compression of the canisters;

compressing the column at a high temperature to form a dense ceramic block from the particulate solid, and after sufficient residual time, displacing a processing element through the discharge end of the furnace;

removing applied pressure on the column from time to time and either or both (i) removing a processing element from the discharge end and (ii) inserting a new processing element at the entry end of the furnace;

activating holding means to support the column of processing elements to enable substitution of the lowermost processing element in the column.

2. A method as claimed in claim 1 including the step of moving the processing elements upwardly through the tubular furnace.

3. A method as claimed in claim 1 wherein the step of supplying spacer elements includes the steps of placing a spacer element between each canister such that the processing elements in the column comprise an alternating stream of spacer elements and canisters.

4. A method as claimed in claim 1 wherein the step of supplying the particulate solid in a plurality of canisters includes the step of providing canisters each of generally cylindrical form having axial end walls and a bellows-like convoluted side wall extending between the end walls.

5. A method as claimed in claim 4 wherein the step of supplying spacer elements includes the step of providing spacer elements including ends which have a flat central region surrounded by an annular collar whereby each canister is centralised.

6. A method as claimed in claim 5 in which each canister has a curved junction between each axial end wall and a convoluted side wall.

7. A method as claimed in claim 6 in which each spacer element has a corresponding curve in the junction between the annular collar and the flat central region.

8. A method as claimed in claim 1 wherein the step of supplying spacer elements includes the step of providing spacer elements having an axial length of the same order of magnitude as its diameter.

9. A method as claimed in claim 8 wherein the step of providing spacer elements includes dimensioning the spacer elements to have a close clearance fit within the furnace tube.

10. A method as claimed in claim 1 wherein the step of operating the tubular furnace includes the step of providing the furnace a diameter in the range of 100 mm to 200 mm.

11. A method as claimed in claim 1 wherein the step of compressing the column includes the step of utilizing hydraulic rams arranged above and below the furnace which co-operate to maintain equal forces on the column.

12. A method as claimed in claim 11 including the step of monitoring any difference in the forces applied to the respective rams for indicating if one or more of the processing element is jamming in the furnace.

13. A method of encapsulating particulate solid material in canisters each having a bellows-like side wall, the particulate material being adapted to form under conditions of high pressure and temperature a densified ceramic block of material, the steps comprising:

supplying the canisters with ceramic spacer elements between at least some of the adjacent canisters to establish a vertically upward stream through a tubular vertical furnace, wherein the canisters and the spacer elements comprise processing elements within the furnace;

operating the vertical furnace to establish conditions of high temperature for forming the ceramic material;

applying high pressure vertically through the stream to compress it; and removing the applied high pressure from time to time and either or both (i) removing a processing element from a discharge end of the furnace, and (ii) inserting an additional canister or spacer element at an entry end of the furnace.

14. A method as claimed in claim 13 including the step of activating holding means to support the stream to enable substitution of the lowermost processing element in the stream.

15. A method as claimed in claim 13 wherein the step of applying high pressure vertically through the stream to the compress it includes the step of utilizing hydraulic rams arranged above and below the vertical furnace which cooperate to maintain equal forces on the stream.

16. A method as claimed in claim 13 including the step of monitoring any difference in the forces applied to the respective rams for indicating if one or more of the processing elements is jamming in the furnace.

17. A method as claimed in claim 13 including the step of moving the processing elements upwardly through the tubular furnace.

18. A method as claimed in claim 17 wherein the step of supplying the canisters with ceramic spacer elements includes the steps of placing a spacer element between each canister such that the processing elements in the stream comprise an alternating stream of spacer elements and canisters.

19. A method as claimed in claim 18 wherein the step of supplying canisters with ceramic spacer elements includes the step of providing canisters each of generally cylindrical form having axial end walls and a bellows-like convoluted side wall extending between the end walls.

20. A method as claimed in claim 19 wherein the step of supplying canisters with ceramic spacer elements includes the step of providing spacer elements including ends which have a flat central region surrounded by an annular collar whereby each canister is centralized.

21. A method as claimed in claim 20 in which each canister has a curved junction between each axial end wall and a convoluted side wall, and in which each spacer element has a corresponding curve in the junction between the annular collor and the flat central region.

* * * * *